US006148693A

United States Patent [19]

Filipowers

[11] Patent Number: 6,148,693

[45] Date of Patent: Nov. 21, 2000

[54] TOOL FOR MAINSPRING REMOVAL

[76] Inventor: Zbigniew Filipowers, 360 E. Tulane Dr., Altamonte Springs, Fla. 32701

[21] Appl. No.: 08/908,934

[22] Filed: Aug. 8, 1997

[51] Int. Cl.[7] ..... G04D 3/00

[52] U.S. Cl. ..... 81/6; 81/7.5; 29/227

[58] Field of Search ..... 81/6, 7.5; 29/227, 29/225, 281.1, 228

[56] References Cited

U.S. PATENT DOCUMENTS

| | | | |
|---|---|---|---|
| 1,361,548 | 12/1920 | Rinn | 29/228 |
| 2,549,325 | 4/1951 | Mongelli et al. | 81/6 |
| 2,571,879 | 10/1951 | Hill et al. | 81/7.5 |
| 3,106,115 | 10/1963 | Renz | 81/6 |
| 5,694,689 | 12/1997 | Filipowers | 81/6 |

*Primary Examiner*—David A. Scherbel
*Assistant Examiner*—Willie Berry, Jr.
*Attorney, Agent, or Firm*—Elsie C. Turner

[57] ABSTRACT

A tool improved over the prior art provides a means for easily and safely removing a timepiece mainspring from its barrel for cleaning and lubricating. A barrel holder is provided having a rim, and an essentially planar surface which includes openings therethrough. A mainspring barrel containing a mainspring is inserted into a mating opening. A barrel holder cap is snapped over a rim of the barrel holder. The cap surface includes openings opposite the barrel holder openings. The cap and barrel holder thereby form a receptacle for receiving an extracted mainspring. The watchmaker accesses a loop of the mainspring in the barrel holder, and removes the mainspring. The energy in the spring is thereby released and the expanding spring is captivated in the receptacle, permitting removal therefrom for cleaning and lubricating. In an improved version of the invention, a circular disc having a plurality of circular openings for receiving mainspring barrels of varying size. The disc is pivoted to place a desired size opening adjacent a chamber having an adjustable volume and access to the mainspring.

3 Claims, 3 Drawing Sheets

FIG. 7
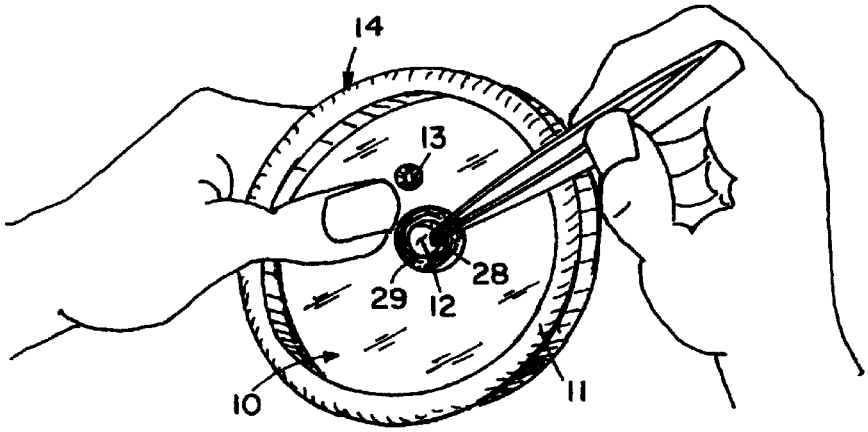
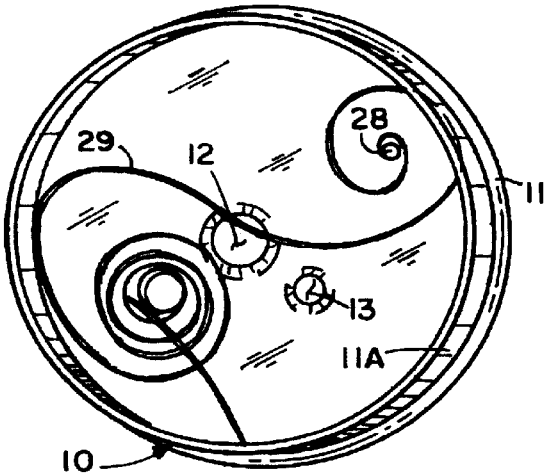
FIG. 8
FIG. 9
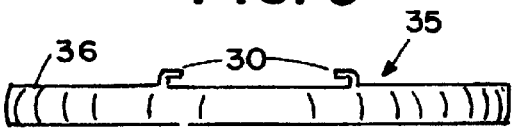
FIG. 10
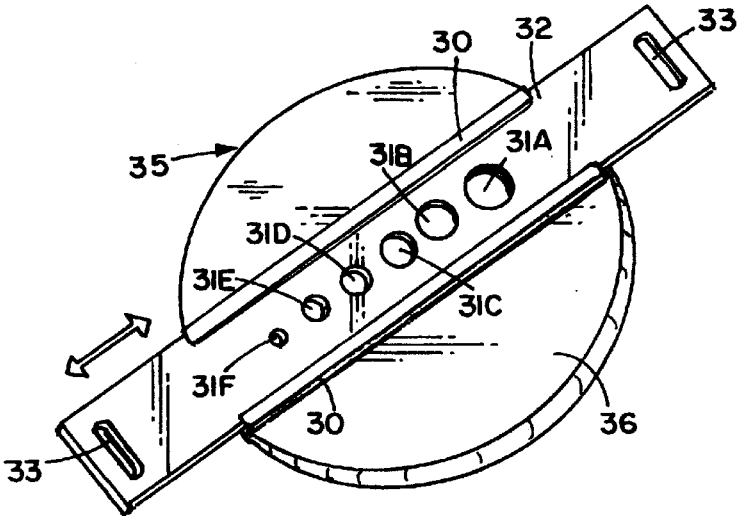

TOOL FOR MAINSPRING REMOVAL

BACKGROUND OF THE INVENTION

1. Field of the Invention

The present invention relates to tools used by watchmakers, and more particularly to an improved tool that permits, during cleaning and repair of a watch, removal of the mainspring from its barrel easily and safely, and without possibility of loss thereof or injury to the watchmaker.

2. Brief Description of the Prior Art

Watches and clocks utilize a mainspring coiled within a cylindrical barrel, and having a gear ring disposed around an open end of the barrel. The inner end of the coiled mainspring includes a small loop therein. During repair or cleaning of a watch, clock, or the like, the mainspring should be removed from its cylindrical barrel, and cleaned in a cleaning solution to remove dried oil or other contaminants. The cleaned mainspring is then lubricated and replaced in its barrel. Mainspring barrels will range in size from a few millimeters to very large. As will be understood, regardless of the size of the mainspring, a relatively large amount of energy is stored therein, even in its most relaxed state.

In the prior art, during disassembly of a watch or clock, the watchmaker removes the barrel containing the mainspring. He then grasps the small loop formed in the inner end of the spring with tweezers or the like, and pulls outward. This action releases the stored energy of the spring, causing the spring to unwind suddenly. In many cases, this sudden release of energy causes the spring to slip out of the tweezers grip. The spring, and the barrel, may fly across the room, requiring a hunt for the parts. At worst, a very small spring may be lost, or the spring may strike the watchmaker in the face thereby causing injury.

Thus, there is a long felt need for a simple tool to permit a mainspring to be easily removed from its barrel without danger of loss or of injury to the watchmaker.

SUMMARY OF THE INVENTION

The mainspring removal tool of the invention includes a circular mainspring barrel holder formed of thin spring brass or the like, and having a narrow rim therearound. The barrel holder includes a circular central hole having the dimension of the largest standard mainspring barrel to be accommodated. A plurality of smaller circular holes may also be provided, each of the holes having the diameter of a different size barrel. The smaller holes are preferably arranged in a circle around the central hole.

A barrel holder cap is provided that mates with the rim of the barrel holder. The surface of the cap includes a central opening slightly smaller than the barrel holder central hole. A second small hole is provided adjacent the central hole thereof and having a center on the radius of the circle formed by the centers of the plurality of smaller holes.

To use the invention, the cap is snapped into the barrel holder. A barrel having a mainspring therein is inserted in the appropriately sized hole in the barrel holder with the barrel projecting within the rim and the gear ring contacting the outer surface of the rim. The barrel holder is then inverted thereby exposing an inner mainspring loop within the matching hole in the cap. A barrel holding knob having a small knob pin extending therefrom is inserted then through the center of the mainspring barrel.

The watchmaker holds the assembly in one hand with the knob held by the fingers and the cap by the thumb. The other hand may then grasp the small inner loop of the mainspring with tweezers through the matching cap hole. By pulling upon the loop, the mainspring will then slide out of the barrel, quickly unwind, and be captivated by the rim of the cap. The barrel is removed and the cap unsnapped from the barrel holder, thereby giving the watchmaker easy access to the mainspring in its relaxed condition in the cap.

It is therefore a principal object of the invention to provide a tool for permitting a watchmaker to remove a coiled mainspring from its barrel quickly and easily without danger of loss or injury to himself.

It is another object of the invention to provide means for safely and easily removing a mainspring from its barrel and that can accept a wide range of barrel sizes.

It is yet another object of the invention to provide a simple, low cost tool for permitting removal of a mainspring from its barrel without danger of the mainspring being permanently or temporarily lost.

These and other objects and advantages of the invention will become apparent from the following detailed description when read in conjunction with the drawings.

BRIEF DESCRIPTION OF THE DRAWING

FIG. 7 is a perspective view of the assembly of FIG. 6 showing the method of removing a mainspring from its barrel in accordance with the invention;

FIG. 8 is a perspective view of the mainspring barrel holder cap with the barrel holder removed a showing a removed mainspring therein with the mainspring ready for cleaning and oiling;

FIG. 9 is a side view of an alternative mainspring barrel holder element of the invention; and FIG. 10 is the barrel holder element of FIG. 9 showing a changeable slide installed therein having a plurality of barrel receiving openings.

DETAILED DESCRIPTION OF THE PREFERRED EMBODIMENT

Figure 1:
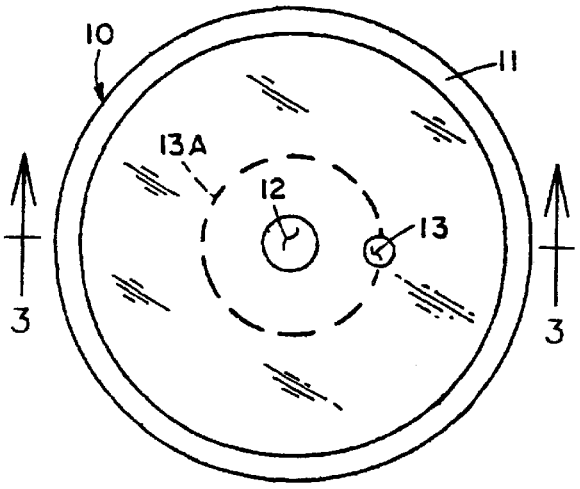
FIG. 1 is a plan view of a barrel holder cap of the invention.

One embodiment of the invention is shown in FIGS. 1 through 6. FIG. 1 is an outer plan view of a barrel holder circular cap 10 having a top surface 10A and an outer curved rim portion 11. Although cap 10 may be formed from various materials, a transparent material, such as an acrylic plastic, is preferred. A circular hole 12 is formed in the center of cap 10, along with a smaller hole 13 provided at a point on imaginary circle 13A. A depending rim 11A, as best seen in the cross-sectional view A—A of FIG. 3, extends downwardly from outer rim portion 11, having a slightly smaller diameter than outer rim portion 11. It is to be understood that the depth of rim 11A and of the barrel holder rim 16 may be selected in accordance with the height of the mainspring barrels desired to be accommodated, as will be described herein below.

Figure 2:
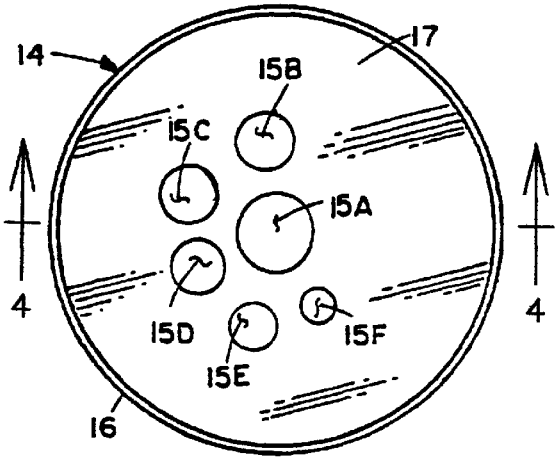
FIG. 2 is a plan view of a mainspring barrel holder showing a plurality of circular holes for receiving a variety of spring barrels.
Figure 4:
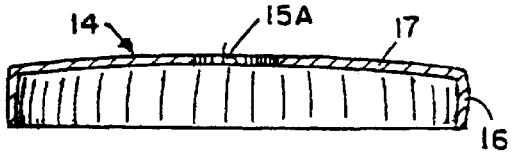
FIG. 4 is a cross sectional view of the mainspring barrel holder of FIG. 2 through the plane B—B thereof.

A mainspring barrel holder 14 for mainspring barrels is shown in FIG. 2 in an inner plan view thereof. Barrel holder 14 is preferably formed of a thin metal such as brass. The underside of an essentially flat surface 17 is shown having a plurality of holes of various sizes 15A through 15F therein. Each hole is selected to match the outer diameter of a standard mainspring barrel. It is to be noted that hole 12 of cap 20 in FIG. 1 is smaller than hole 15A of FIG. 2. Similarly, hole 13 of FIG. 1 is smaller than any of holes 15B to 15F which are arranged on a circle having the same diameter as circle 13A of FIG. 1. In FIG. 4, a slightly curved rim 16 is formed around, and depends from, the circumference of holder 14 as seen in the cross-sectional view through plane B—B of FIG. 2.

Figure 3:
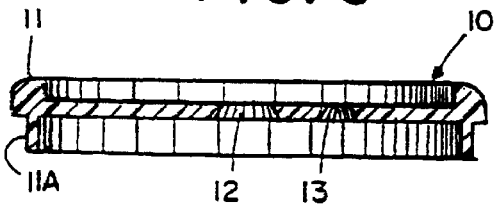
FIG. 3 is a cross-sectional view of the barrel holder cap of FIG. 1 through the plane A—A thereof.

As best seen in FIG. 3, each of holes 12, 13 of cap 10 is preferably countersunk on the underside thereof.

Figure 5:
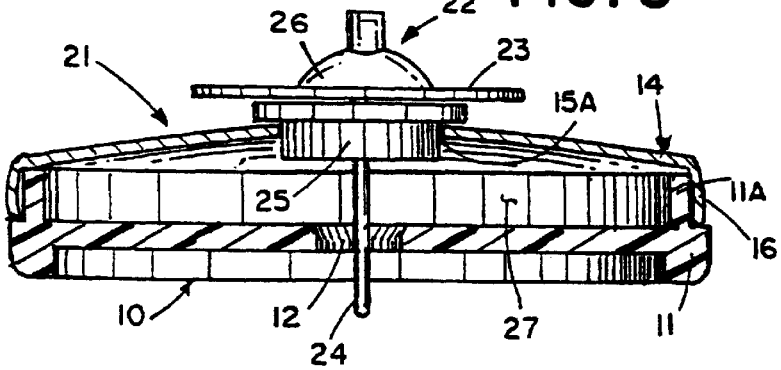
FIG. 5 is a cross sectional view of the assembled tool of the invention having a typical mainspring barrel mounted therein, and having the barrel holding knob inserted through the barrel.
Figure 6:
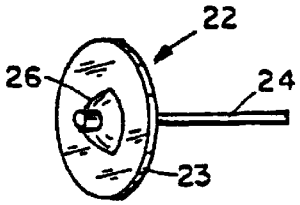
FIG. 6 is a perspective view of a barrel holding knob.

Turning now to FIGS. 5 and 6, an assembly 21 of cap 10, holder 14 and barrel holding knob 22 is shown in cross-sectional view. Knob 22, as seen in the perspective view of FIG. 6, has been inserted through a center pivot hole of a typical mainspring barrel 25, hole 15A of barrel socket element 14, and countersunk hole 12 of cap 10. As will be recognized, a space 27 has been formed between the lower edge of barrel 25 and the inner surface of cap 10 for receiving and captivating the mainspring in barrel 25 after removal therefrom. Barrel holding knob 22 includes a pin 24, a holding skirt 23, an a knob 26.

The operation of the mainspring removal tool will be explained with reference to FIGS. 5, 6, 7, and 8. The watchmaker, after removing the mainspring and barrel 25 from a watch, inserts barrel into the hole 15A–15F that matches the outer circumference of the barrel as shown in FIG. 5. The watchmaker grasps the assembly of FIG. 5 with one hand between the thumb and fingers, holding the fingers over knob 26 and skirt 23, with the thumb on cap 10 as shown in FIG. 7. The barrel holder surface 17 may then be squeezed, causing it to "oil-can", or snap downward, narrowing the gap 27 of FIG. 5. The mainspring will now be visible through central hole 12 of cap 10, with the loop 28 formed in the inner end of the mainspring being visible. The watchmaker then grasps the spring loop 28 with the tweezers, and relaxes the barrel holder surface 17, allowing it to return to its original position thereby increasing the depth of gap 27. As seen in FIGS. 3 and 6, holes 12 and 13 are countersunk on the underside of the cap 10, thereby assuring that the spring loop 24 will be accessible to be grasped the tweezers.

After grasping loop 24, the watchmaker pulls the spring loop 28 outward, causing the spring to slide from its barrel 25 into space 27. As the spring 29 relaxes it spreads outwardly and is thereby captivated by depending rim 11A of cap 10. The watchmaker may then remove knob 22 and barrel 25 from the assembly. The barrel holder 14 is then removed from space 27 of cap 10, exposing the released spring as shown in FIG. 8. The watchmaker can then remove the captivated spring 29 from holder 14, ready for cleaning and lubricating.

Referring now to FIGS. 9 and 10, an alternative design of the mainspring removal tool of the invention is shown. A barrel holder body portion 35 is shown in edge view in FIG. 9. The top surface 36 has a pair of tracks 30 formed therein. FIG. 10 shows body portion 35 in perspective view in which a slide 32 has been inserted in tracks 30. A plurality of holes 31A–31F, matching the diameters of standard barrel sizes is formed in slide 32. After snapping body portion 35 over cap 10 of FIG. 1, the watchmaker inserts a slide having the desired hole sizes, and places the mainspring and barrel in the proper size hole 31. He then inverts the assembly, installs cap 21 over rim 11A, and moves slide 32 by means of grips 33 to align with hole 12. Knob 22 is inserted, and the mainspring removed as described hereinabove. As will be apparent, the tool 35 may include a plurality of slides 32, each with different size holes, such that a very wide range of barrel sizes can be accommodated.

The improved embodiment of the invention will be described with reference to FIG. 11 and FIG. 12 of the drawings. This version of the invention permits adjustment of the area in which a mainspring is captivated after removal fom its barrel. Thus, a wide variety of sizes of mainsprings can be safely and easily removed from barrels of various sizes.

Figure 11:
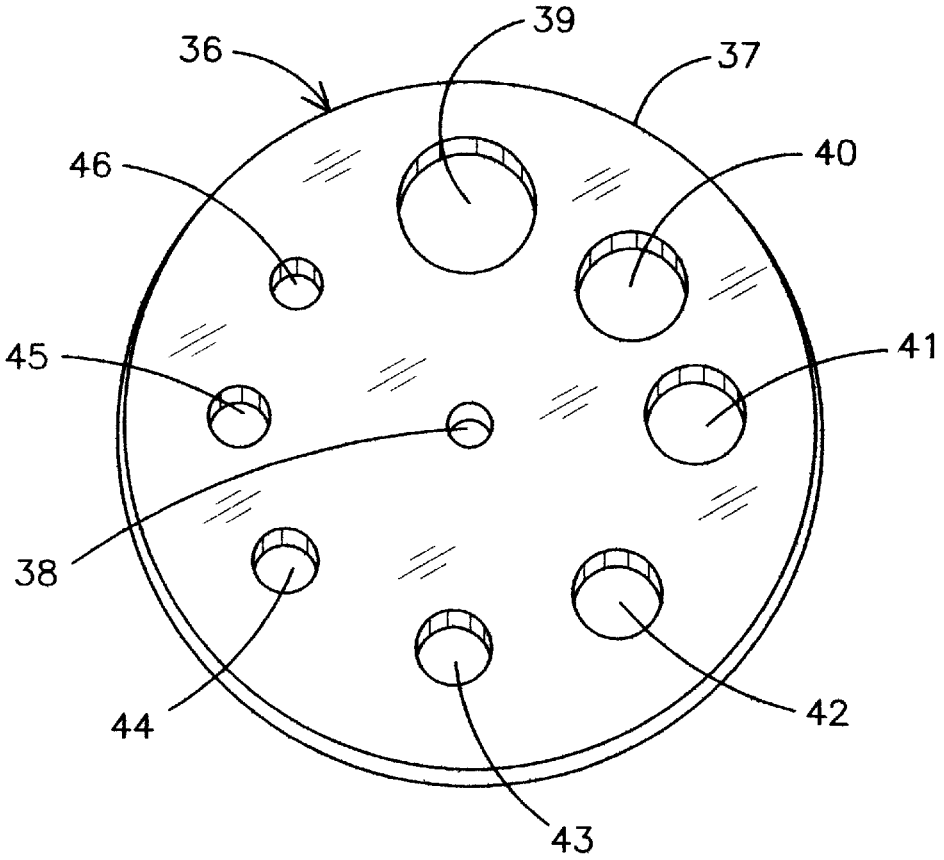
FIG. 11 is perspective view of a circular disk element which may be formed from plastic or the like for use in an improved version of the invention.

As seen in FIG. 11, a disk 36 is formed, preferably from a thin plastic material such as Plexiglas 37. A central hole 38 is provided, as will be described below, to permit the watchmaker to quickly select an opening in one of the circular holes 39 through 46 disk 36 that accepts the spring barrel which is to be worked on. Thus, a plurality of openings for various size barrels is formed in a circular pattern around the perimeter of the disk.

Figure 12:
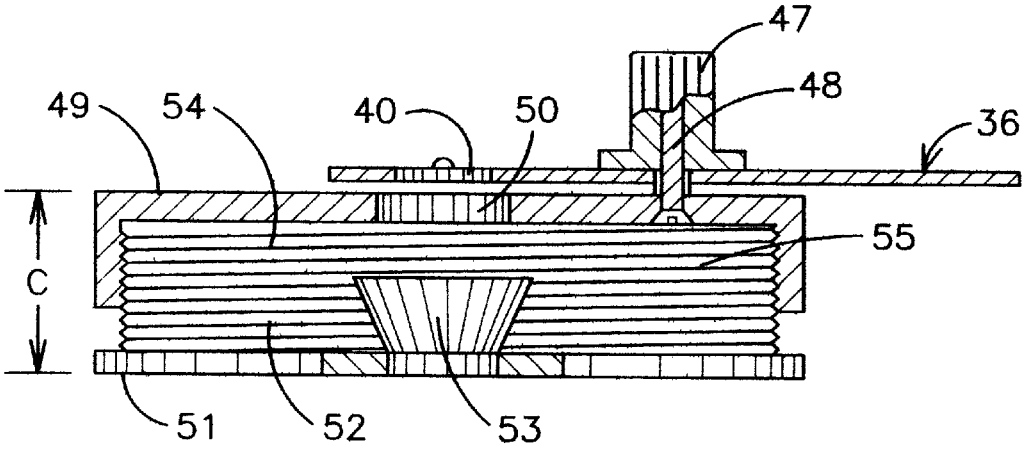
FIG. 12 is a cross sectional view of the improved version of the tool of the invention.

FIG. 12 is a cross-sectional view of the improved tool, showing disk 36 installed thereon. The tool utilizes a circular cap element 49 which may be fabricated from stainless steel, brass, or the like and having a set of fine threads in the interior wall thereof. Cap element 49 includes a circular opening 50 in the center thereof. A flat head machine screw 48 is installed near an outer edge of of the cap element 49 such that the central opening 38 of disk 35 can be installed thereon. A thumbscrew 47 having an internal thread matching machine screw 48.

After selection of the desired barrel hole in disk 36, the disk 36 is rotated to place, for example, barrel hole 40 over circular opening 50. The desired barrel can then be installed in the matching hole 40. Thumbscrew 47 can then be tightened on screw 48 to temporarily lock the desired barrel hole in place.

Inasmuch that mainspring barrels are found in a large variety of sizes and widths of the springs, the improved tool includes an adjustable volume 55 as indicated by arrow C. In the cross sectional view of FIG. 12, it may be noted that threads 52 mating with threads 54 of volume 55. By rotating cap portion 51, the thickness of volume 55 can thus be adjusted to match the width of the mainspring being removed. When the proper volume is set, the watchmaker can then safely grasp the spring in the barrel and permit it to relax within volume 55.

It is to be noted that the safety aspect of the improved version of the invention is especially advantageous when the watchmaker is working with Rolex mechanical watch movements since the mainspring coils are very strong. Advantageously, the variable volume feature permits constraining the uncoiling spring to such volume.

A tool and method for safely and easily removing a mainspring from a timepiece for cleaning and lubricating has been disclosed having a mainspring barrel holder and a cap for receiving the mainspring upon removal. Although a specific design has been shown for illustrative purposes, it will be clear to those of skill in the art that various changes thereto may be made without departing from the spirit and scope of the invention.

I claim:

1. An improved tool for safely and easily removing a wound mainspring from its barrel comprising:

a) a circular disc having a central pivot hole;

b) said circular disk having a plurality of circular openings arranged in a circle around said central pivot hole, each of said openings being of a different diameter, said openings for accepting main spring barrels;

c) a circular cap element having a central opening therethrough, said cap element having internal threads therein;

d) a vertical screw near the periphery of said cap element, said disk central pivot hole mounted on said screw, said circular disc having a thumbscrew for securing said circular disc in any of a plurality of positions relative to said central pivot hole;

e) a rotating cap portion having a central opening therethrough, and external threads to permit said cap portion to be threaded into said internal threads to thereby vary the volume between said cap element and said cap portion, said cap portion having a central opening therethrough to permit access to a mainspring in said central hole of said disc for removal of said mainspring, and captivating said mainspring within said adjustable volume.

2. The tool as defined in claim 1 which includes a plurality of said circular discs having differing sized openings therein.

3. A method for safely removing a wound mainspring from its barrel comprising the steps of:

a) providing an improved tool having (i.) a circular disk having a central pivot hole, (ii) a plurality of circular openings arranged in a circle around said central pivot hole, each of said openings being of a different diameter for accepting main spring barrels of differing sizes, (iii) a circular cap element having a central opening therethrough and internal threads therein, (iv) a vertical screw near the periphery of said cap element, said disk central pivot hole mounted on said screw, said circular disc having a thumbscrew for securing said circular disc in any of a plurality of positions relative to said central pivot hole, (v) a rotating cap portion having external threads to permit said cap element to be threaded into said internal threads to thereby vary the volume between said cap element and said cap portion, said cap portion having a central opening therethrough to permit access to a mainspring in said central hole of said disc;

b) selecting a barrel opening of desired size by rotating said disk to place said barrel opening over said cap central opening;

c) installing a mainspring barrel with mainspring in said barrel opening;

d) temporarily locking said barrel opening in place by tightening said thumbscrew;

e) rotating said cap portion to adjust said volume between said cap element and said cap portion to match the width of the mainspring being removed;

f) grasping said mainspring through said cap opening; and g) removing said mainspring from its barrel, causing said mainspring to expand into said mainspring receiving and capturing space.

* * * * *